United States Patent [19]

Kawashita et al.

[11] 4,035,010

[45] July 12, 1977

[54] DEVICE FOR GRIPPING AND LIFTING T-SHAPED STRUCTURAL MEMBER

[75] Inventors: Hiroshi Kawashita; Takeshi Sakano; Nobuyoshi Hanada, all of Kure, Japan

[73] Assignee: Ishikawajima-Harima Jukogyo Kabushiki Kaisha, Ote, Japan

[21] Appl. No.: 670,133

[22] Filed: Mar. 25, 1976

[30] Foreign Application Priority Data

May 8, 1975 Japan ..... 50-61871

[51] Int. Cl.[2] ..... B66C 1/64

[52] U.S. Cl. ..... 294/81 R; 294/101

[58] Field of Search ..... 294/16, 34, 67 R, 67 AA, 294/67 B, 67 BB, 78 A, 81 R, 85, 86 R, 90, 91, 101, 114, DIG. 1, DIG. 2; 24/263 A; 248/226 B, 228; 214/1 QA, 1 QG

[56] References Cited

U.S. PATENT DOCUMENTS

| | | | |
|---|---|---|---|
| 1,128,277 | 2/1915 | Adler | 248/228 X |
| 1,516,973 | 11/1924 | Loughran | 294/81 R |
| 1,974,628 | 9/1934 | Presley | 248/228 |
| 2,421,257 | 5/1947 | Genter | 24/263 A X |
| 3,002,779 | 10/1961 | Frate et al. | 294/67 BB |
| 3,462,025 | 8/1969 | Toffolon | 294/81 R X |
| 3,572,803 | 3/1971 | Pompe | 294/81 R |
| 3,589,659 | 6/1971 | Larkin | 24/263 A X |

*Primary Examiner*—Johnny D. Cherry

*Attorney, Agent, or Firm*—Scrivener, Parker, Scrivener & Clarke

[57] ABSTRACT

The present invention discloses a device for gripping and lifting large-sized T-shaped structural members (to be referred to as the "T structural member" for brevity in this specification) each consisting of a face plate and a web plate. The T structural member gripping and lifting device comprises a beam adapted to be suspended from a crane or the like, a plurality of trolleys movably mounted on the beam and remotely controlled so as to adjust the spacing therebetween, a gripping unit suspended from each trolley and remotely controllable so as to grip or release the face plate of a T structural member, and a remote control unit for controlling the trolleys and the gripping units whereby the T structural member may be automatically gripped, lifted and released. Handling efficiency may be considerably increased to such an extent hitherto unattainable by any conventional devices, and the safeguarded operations may be ensured.

4 Claims, 11 Drawing Figures

Fig. 1
PRIOR ART
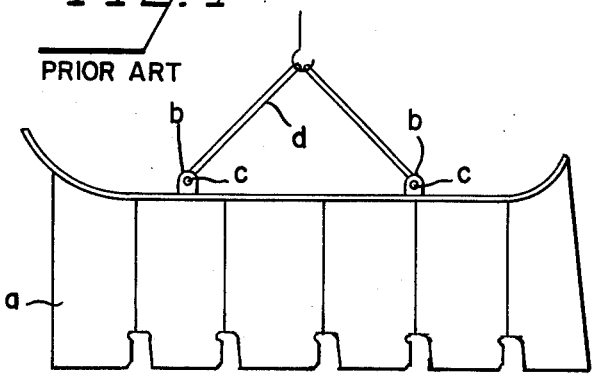
Fig. 2
PRIOR ART
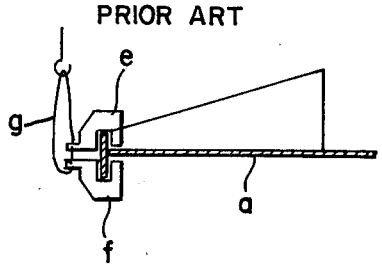
Fig. 4
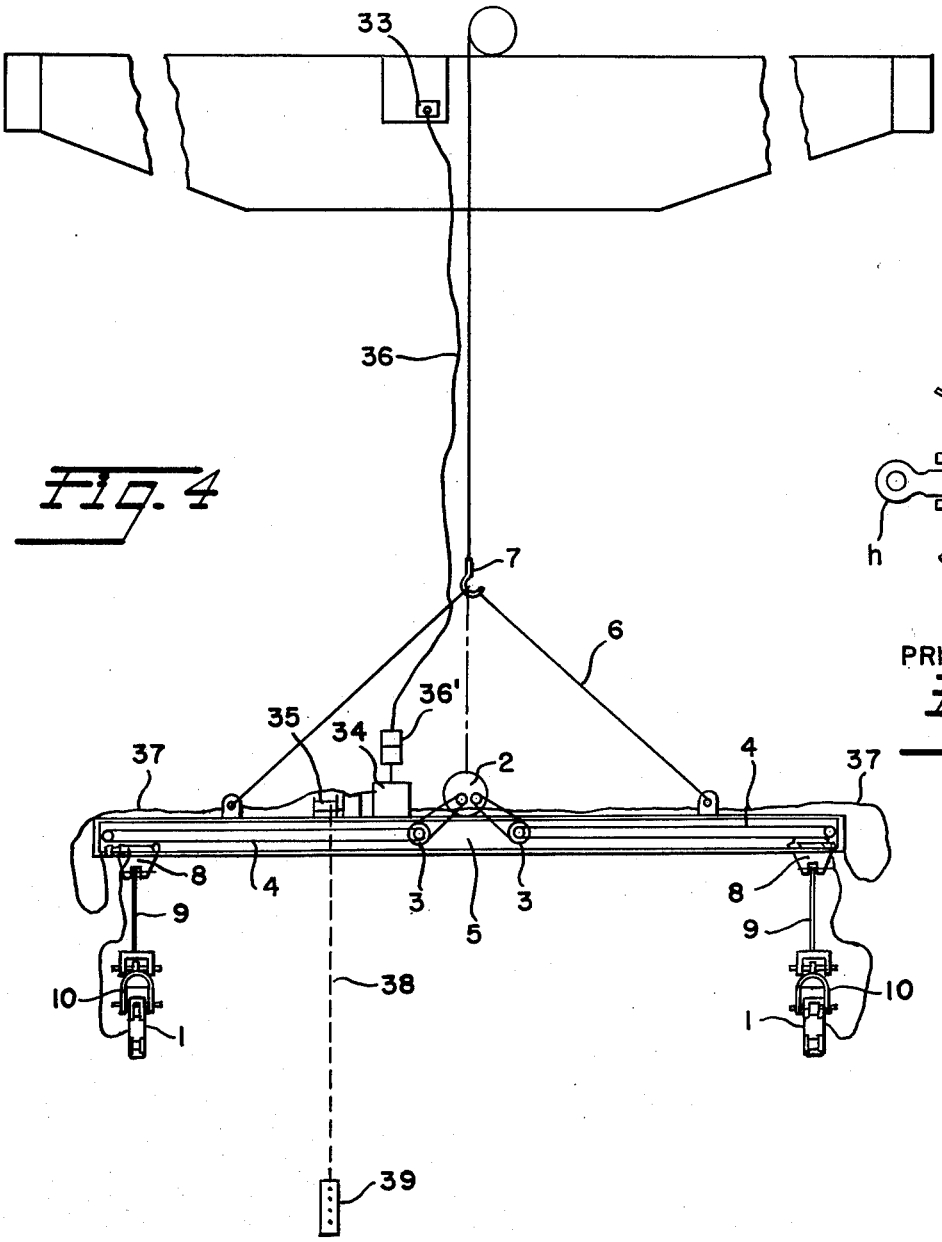
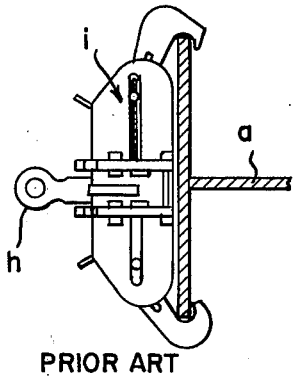
PRIOR ART
Fig. 3

FIG. 8A
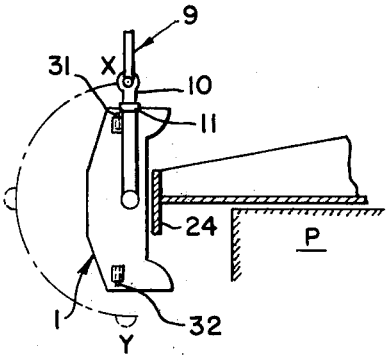
FIG. 8B
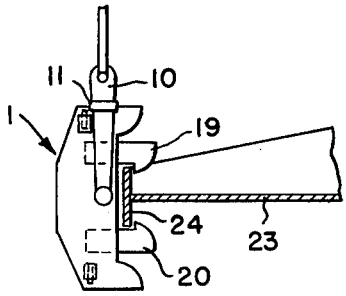
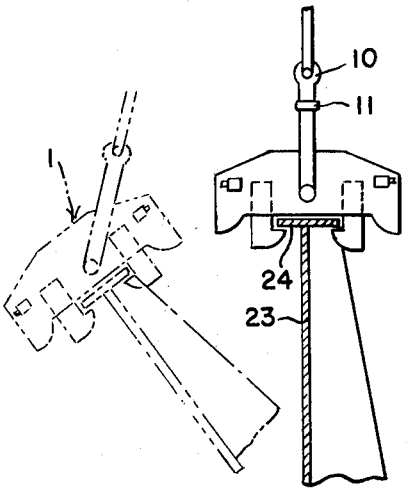
FIG. 8C
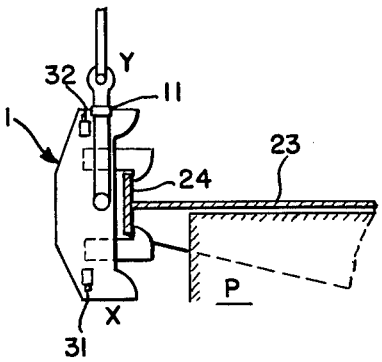
FIG. 8D

DEVICE FOR GRIPPING AND LIFTING T-SHAPED STRUCTURAL MEMBER

DETAILED DESCRIPTION OF THE INVENTION

The conventional methods for gripping and suspending the T structural members may be divided into the following three types.

In the first type, as shown in FIG. 1, lifting pieces *b* are joined by welding to a T structural member *a* to be lifted, and wire ropes *d* are attached to the lifting pieces *b* through shackles *c*.

In the second type, as shown in FIG. 2, the T structural member *a* is firmly gripped with gripping members *e* and *f* which in turn are attached to a wire rope *g*.

In the third type, as shown in FIG. 3, the T structural member *a* is firmly gripped by a ratchet device *i* with a lifting piece *h*.

The above methods however have inherent defects. In the first type, i. The lifting pieces must be fabricated;

ii. Attachment and removal of the lifting pieces are time-consuming and tedious; and iii. When the T structural members are those of a ship's hull, they are hoisted and erected at a high place so that a movable ladder or the like is required for the removal of the lifting pieces and the removal of the lifting pieces at a high place is dangerous. In the second type, i. When the T structural member *a* is erected, its load is exerted only to the gripping member *f* so that there is a fear that an accident happens;

ii. When the T structural member *a* is rested on the ground and the wire rope *g* is slacked, the wire rope *g* tends to be released from the gripping members; and iii. Depending upon the width and thickness of the face plate of the T structural member *a*, the gripping members *e* and *f* with various sizes are required so that the hoisting operation is not economical and not simple.

iv. The safety use is impossible against the high weight T structural member. In the third type, i. The point of lift is a point on the lifting piece *h* so that the setting of the device is difficult. In addition, the size of the device and hence the size of the T structural member *a* are limited because the device must be manually handled;

ii. When the T structural member *a* is one for building a ship's hull, it is often hoisted and erected at a high place so that a movable ladder or the like must be used for the removal of the lifting device and the removal operation at a high place is dangerous; and iii. Because the lifting device is of a ratchet type, the attachment and removal of the lifting device are time-consuming.

In view of the above, one of the objects of the present invention is to provide a T structural member gripping and lifting device which may considerably reduce the time and labor required for attaching and removing the conventional lifting pieces such as eye-plates so that the handling efficiency may be remarkably increased.

Another object of the present invention is to provide a T structural member gripping and lifting device which may automatically grip the T structural member, thereby eliminating the manual removal of the shackles and the like at a high working position and consequently ensuring the safe handling operation.

A further object of the present invention is to provide a T structural member gripping and lifting device which may firmly grip even the curved face plate of the T structural member.

The present invention will become more apparent from the following description of one preferred embodiment thereof taken in conjunction with the accompanying drawing in which;

FIGS. 1, 2 and 3 are schematic views used for the explanation of the conventional methods for gripping and lifting the T structural members;

FIG. 4 is a view illustrating the whole construction of the T structural member gripping and lifting device in accordance with the present invention;

FIGS. 8(A), (B), (C) and (D) are schematic views used for the explanation of the steps for turning over or reversing the T structural member with the gripping and lifting device in accordance with the present invention.

Figure 5:
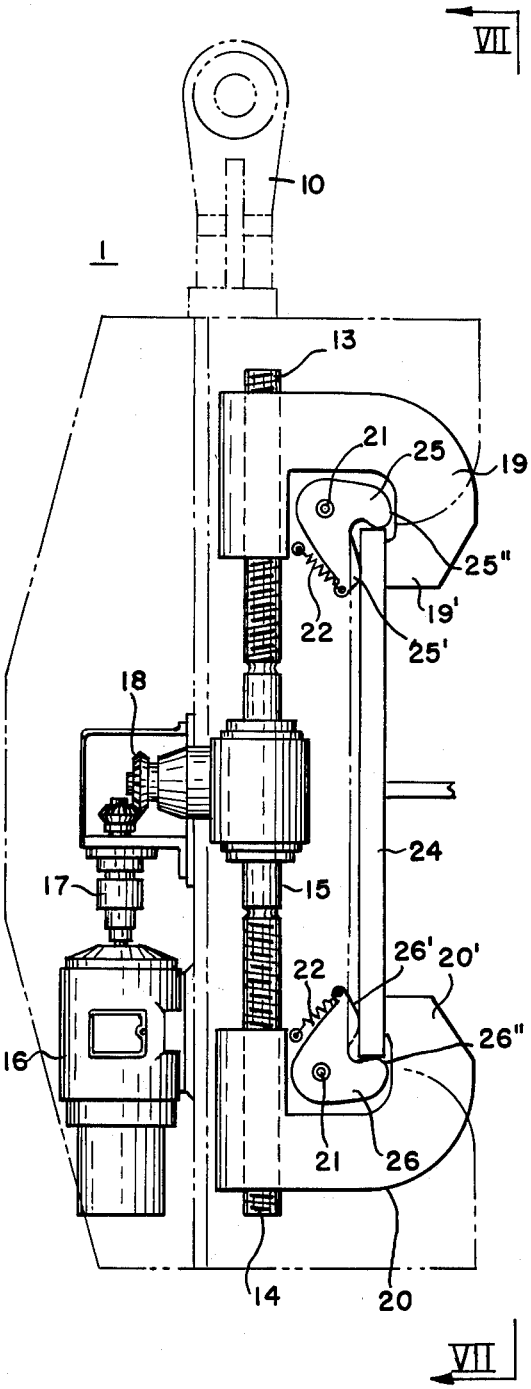
FIG. 5 is a side view of a gripping unit with a supporting plate removed.

Referring to FIG. 4, a beam 5 with a suitable length for the size of T structural member to be lifted is suspended from a crane or the like through a wire rope 6 and a crane hook 7. A plurality of trolleys 8 (two in this embodiment) are movably mounted on the beam 5, and are drivingly coupled to an electric motor 2 through endless roller chains 4 wrapped around sprocket wheels 3 so that the spacing between the trolleys 8 may be suitably adjusted. A gripping unit 1 is suspended from each trolley 8 through a connecting bar 9 and a shackle 10.

Figure 6:
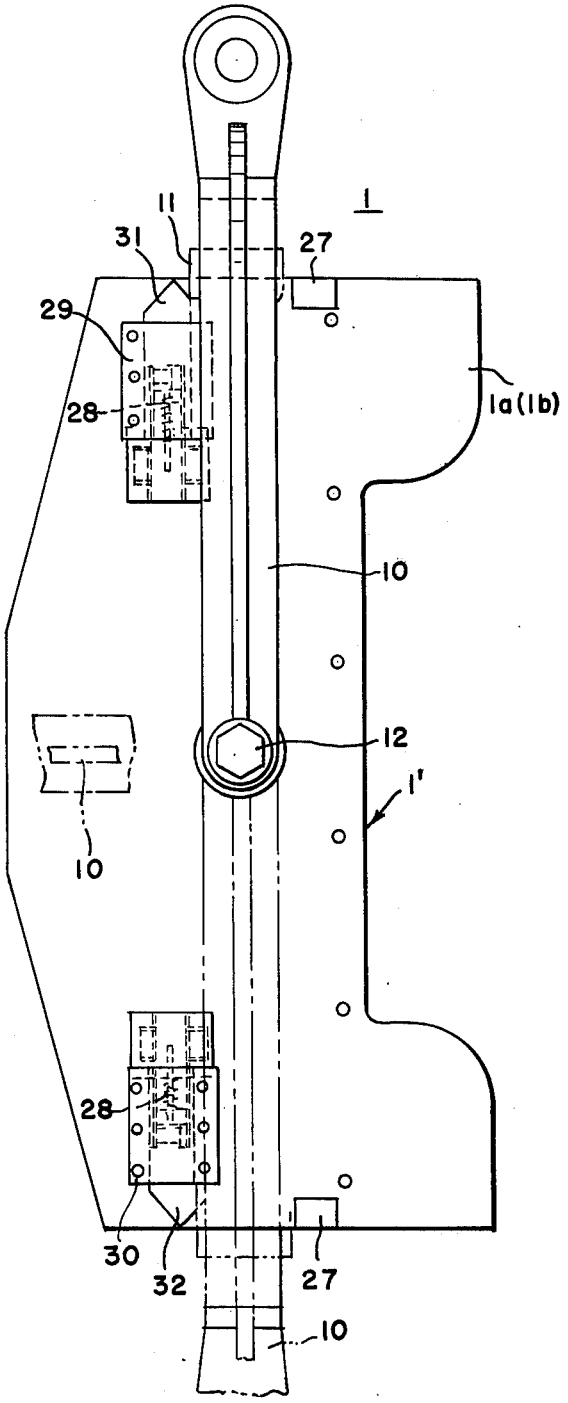
FIG. 6 is a side view thereof.
Figure 7:
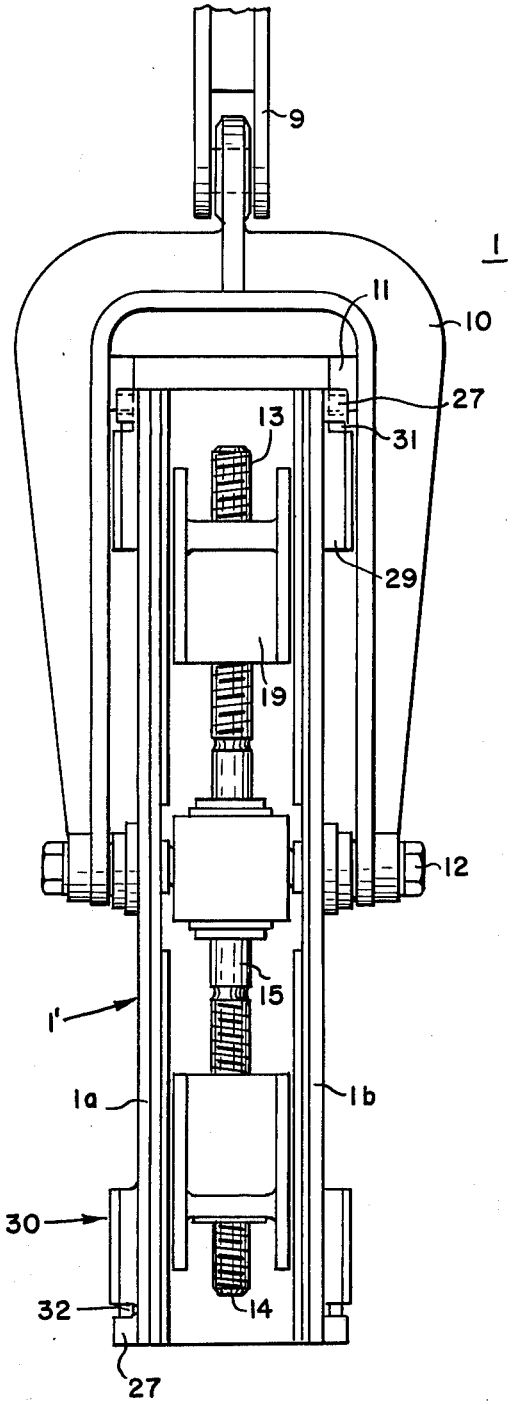
FIG. 7 is a side view thereof looking in the direction indicated by the arrows VII in FIG. 5.

The construction of the gripping unit 1 is shown in FIGS. 5, 6 and 7. The gripping unit 1 includes a supporting body 1' consisting of supporting plates **1*a* and 1*b* rotatably carried with pivot pins 12 by the shackle 10 and spaced apart in parallel from each other by a suitable distance. A driving screw rod 15 disposed inside the supporting body 1' has externally and oppositely threaded screw sections 13 and 14. That is, when the screw section 13 is right-handed the screw section 14 is left-handed, and vice versa. The driving screw rod 15 is drivingly coupled through gears 18 and a torque tender 17 to an electric motor 16 so that the driving screw rod may be rotatable in either direction. The screw sections 13 and 14 of the driving screw rod 15 are screwed into gripping cams 19 and 20, respectively, with supporting portions 19' and 20' so that upon rotation of the driving screw rod 15 the gripping cams 19 and 20 may be moved toward or away from each other for gripping or releasing the face plate of the T structural member. A pressure plate 25 or 26 is pivoted with a pin 21 to the gripping cam 19 or 20, and is loaded with a return spring 22. Th pressure plate 25 or 26 is bifurcated to provide a pressing section 25' or 26' and an engaging section 25'' or 26'' . As will be described in detail hereinafter, when the pressure plate 25 or 26 is caused to swing about the pivot pin 21 as the side edge of the face plate 24 of a T structural member (whose web plate is denoted by 23) engages with and pushes the engaging section 25'' or 26'', the pressing section 25' or 26' is forced against the top surface of the face plate 24**.

Stoppers 27 are provided at the upper and lower sides of each of the supporting plates **1*a* and 1*b* for engagement with stoppers 11 of the shackle 10, and a slider stopper 31 or 32 is slidably fitted into a stopper guide 29 or 30 attached to the supporting plate 1***a* or 1*b* in opposed relation with the stopper 27, and is normally biased to extend out of the stopper guide 29 or 30 under the force of a bias spring 28 so that when the gripping unit 1 is not gripping the T-shaped structural member, the shackle 10 may be held in the vertical position between the stationary stopper 27 and the sliding stopper 31 or 32.

Next the driving and control system will be described with reference to FIG. 4. A relay box 34 mounted on the beam 5 is electrically connected to a power supply of the crane or the like through a cable 36 and a cable winding drum 33 mounted on the crane for winding or unwinding the cable 36 as the beam 5 is lifted or lowered. The cable 36 is connected to the relay box 34 through a connector 36' so that when the T structural member gripping and lifting device in accordance with the present invention is removed from the crane and placed on the ground, the electrical disconnection from the crane may be facilitated. The electric power is supplied from the relay box 34 through cables 37 to the motor 2 mounted on the beam 5 and to the motors 16 mounted in the gripping units 1. A control pendant 39 is suspended through a control cable 38 from a control cable drum 35, and is electically connected to the relay box 34 so that an operator on the ground may control the drive of the motors 2 and 16. As the beam 5 is lifted or lowered, the control cable 38 is wound around or unwound from the control cable drum 35. The drive of the cable winding drum 33 and the control cable winding drum 35 is controlled by an operator in the operator's cab of the crane. In this embodiment, the power has been described as being supplied to the motors 2 and 16 from the same power supply for the crane, but storage batteries may be mounted on the beam 5 so that the motors 2 and 16 may be driven independently of the power supply for the crane.

Next the mode of turning over or reversing the T structural member with the device in accordance with the present invention will be described with reference to FIGS. 8 (A), (B), (C) and (D). First, the shackle 10 is held in the lifting position X between the sliding stopper 31 and the stationary stopper 27, and then the gripping unit 1 is brought close to the face plate 24 of the T structural member as shown in FIG. 8 (A). Next the motor 16 is driven to move the gripping cams 19 and 20 toward each other so that the supporting sections 19' and 20' of the gripping cams 19 and 20 are brought into contact with the rear surface of the face plate 24. The side edge of the face plate 24 push the engaging sections 25'' and 26'' of the pressure plates 25 and 26 so that the latter are caused to rotate about the pivots 21 against the springs 22 and consequently the pressing sections 25' and 26' of the pressure plates 25 and 26 are pressed against the top surface of the face plate 24. As a result, the face plate 24 is firmly gripped between the pressing sections 25' and 26' of the pressure plates 25 and 26 and the supporting sections 19' and 20' of the gripping cams 19 and 20 as best shown in FIGS. 5 and 8 (B) As the T structural member is lifted as indicated by the dotted lines in FIG. 8 (C), the shackle 10 starts to rotate about its pivot pins 12 so that the stoppers 11 of the shackle 10 push down the sliding stoppers 31 against the springs 28 and consequently the shackle 10 is permitted to rotate beyond the sliding stoppers 31. After the stopper 11 of the shackle 10 has passed over the sliding stopper 31, the latter is returned to its initial extended position under the force of the return spring 28. The T structural member is lifted to the upright position as shown in FIG. 8 (C). After the T structural member has been rotated through 180°, it is placed over the surface plate P. Thereafter, the motor 16 is driven in the reverse direction to move the gripping cams 19 and 20 away from each other so that the face plate 24 is released from the supporting sections 19' and 20' of the gripping cams 19 and 20 and from the pressure plates 25 and 26 as shown in FIG. 8 (D). The pressure plates 25 and 26 are returned to their initial position under the forces of the bias springs 22. The stoppers 11 of the shackle 10 pass beyond the sliding stoppers 32 pushing them downward against the springs 28 as the shackle 10 is brought close to the upright position. Therefore, the shackle 10 is held in the upright position Y between the sliding stopper 32 and the stationary stopper 27 as shown in FIG. 8 (D). That the shackle 10 may be held in the upright position X or Y is advantageous for starting the subsequent operation.

When the T-shaped structural member is lifted and moved, the shackle 10 may be freely rotated about its pivot pins 12 between the positions X and Y. Depending upon the size of the T structural member to be lifted, the spacing between the trolleys 8 may be varied, and the operation of the gripping units 1 may be controlled in response to the control signals from the pendant 39. (See FIG. 4)

It is to be understood that the present invention is not limited to the above embodiment and that various modifications may be effected without departing the true spirit of the present invention. For instance, more than two gripping units may be provided.

According to the present invention, the use of the lifting pieces such as eye-plates may be eliminated so that the time required for attachment and removal of such lifting pieces may be saved and consequently the hoisting operation efficiency may be remarkably improved. In addition, the T structural member gripping and lifting device in accordance with the present invention is remotely controlled so that the step for manually removing the shackles and the like at a high working position may be eliminated and consequently the safe hoisting operation may be ensured. Furthermore, the gripping unit is provided with the pressure plates so that the gripping unit may firmly grip even the curved face plate of the T structural member.

What is claimed is:

1. In a structural member gripping and lifting device of the type having a beam, a pair of trolleys mounted on the beam and means to vary the spacing between the trolleys, the improvement comprising a gripping unit suspended from each trolley, each unit including a support having a pair of spaced-apart gripping cams mounted thereon, means on the support for moving said cams toward each other to bring the cams into engagement with one face of said member adjacent opposite edges of the member, a pair of pressure plates engageable with the opposite face of said member so that the member is clamped between the cams and pressure plates, each of said pressure plates having a portion engageable with an edge of the structural member to move the plates into firm engagement with said opposite face of the member in response to operation of said moving means to move the cams toward each other, and a lifting shackle pivotally connected with said support and connected with a trolley.

2. A device as set forth in claim 1 wherein each pressure plate is pivotally mounted on an associated gripping cam, each plate being provided with a pressing portion for contacting the opposite face of the member and an engaging portion engageable with an edge of the structural member, and a return spring connected between the support and the pressing portion.

3. A device as set forth in claim 1 including stopper means for automatically maintaining the lifting shackle in a vertical position, said stopper means comprising a stopper carried by the shackle, a stationary stopper mounted on the support at one side of the shackle for engagement with the first-named stopper and a spring loaded stopper mounted on the support at the other side of the shackle for cooperation with said first-named stopper.

4. A device as set forth in claim 1 including power means for lifting or lowering said beam, a power supply relay mounted on the beam and electrically connected with the power means, and a control pendant suspended from the beam and electrically connected with the power means through the relay for remotely controlling the operation of the power means.

* * * * *